United States Patent [19]

McFarland et al.

[11] 4,063,368

[45] Dec. 20, 1977

[54] LASER WEAPONS SIMULATION SYSTEM

[75] Inventors: Robert L. McFarland, Carmel; Stephen C. Bradshaw, Salinas, both of Calif.

[73] Assignee: Manned Systems Sciences, Inc., Westlake Village, Calif.

[21] Appl. No.: 714,790

[22] Filed: Aug. 16, 1976

[51] Int. Cl.[2] ..... F41G 3/26

[52] U.S. Cl. ..... 35/25; 273/101.1

[58] Field of Search ..... 35/25; 273/101.1, 101.2

[56] References Cited

U.S. PATENT DOCUMENTS

| | | | |
|---|---|---|---|
| 3,573,868 | 4/1971 | Giannetti | 273/101.1 |
| 3,633,285 | 1/1972 | Sensney | 35/25 |
| 3,955,292 | 5/1976 | Robertsson | 35/25 |

*Primary Examiner*—William H. Grieb
*Attorney, Agent, or Firm*—Matthew P. Lynch

[57] ABSTRACT

A multiple laser beam system comprises a laser device which is intended to be attached on or near the barrel of a rifle or the like such that triggering of the weapon activates the laser transmitter and results in the laser device producing a plurality of beams which by means of an adjustable diverging lens on the laser device may be defocused to produce an overlapping pattern. The beams are transmitted sequentially by the laser head assembly while timing of the transmission of the beams is controlled by electronic beam encoding logic. When the weapon is fired a mechanical-to-electrical transducer is energized and generates an electrical signal used to trigger the laser firing sequence. Visual indication means are provided to indicate that the laser timing sequence has been initiated. The light beam is detected by a target having a plurality of light sensing detectors. Whereby an indication of the accuracy of the aim of the weapon may be obtained.

16 Claims, 8 Drawing Figures

Fig. 2A
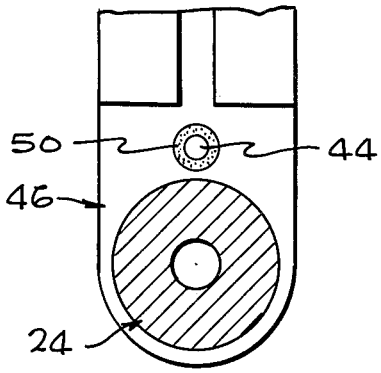
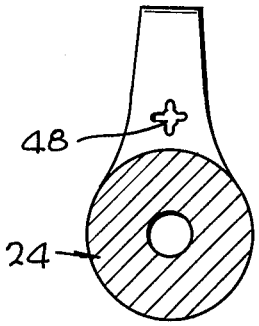
Fig. 2B
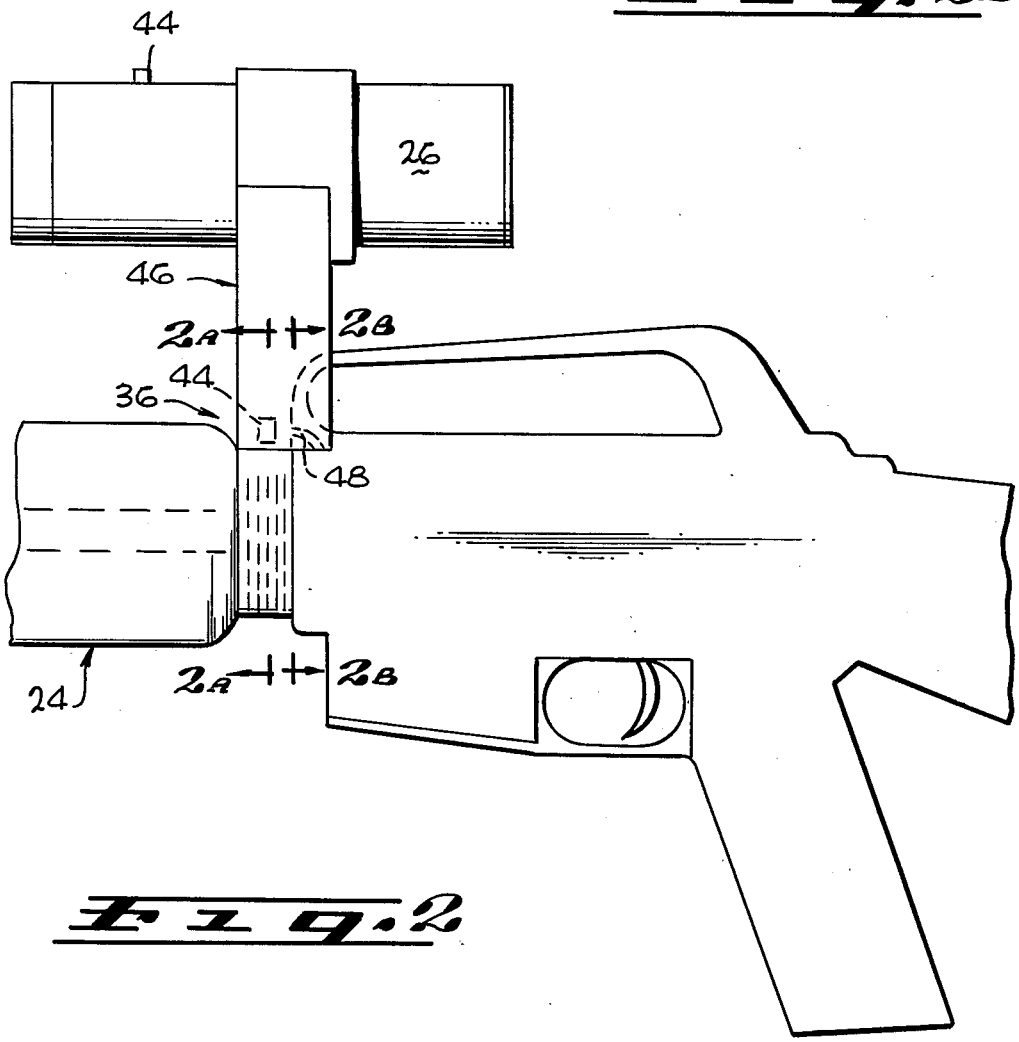
Fig. 2

44
52
54
56
58
MAN.
AUTO
60
62
68
114
116
118
112
120
122
72
74
76
78
96
98
100
102
104
106
108
110
118
70
80
82
84
86

LASER WEAPONS SIMULATION SYSTEM

The invention herein described was made in the course of or under a contract or subcontract thereunder, (or grant), with the Department of the Army.

BACKGROUND OF THE INVENTION

It has been found to be advantageous that automatic fire weapons simulators of the laser-type be used so that military combat practices in the area may be carried out in a realistic fashion.

In the past radiation transmitters have been utilized for emitting a narrow beam of optical radiation, the transmitter being mounted to be aimed with the weapon simulated and combined with detector means oriented to a target and hit and miss indicator means in the form of audio or visual signal means. In man-to-man combat simulation systems of this type the man must be covered with numerous detectors which are easily interfered with, e.g., on military maneuvers or during regular practice. The term commonly used to described this process is "Dry Firing" and indicates the firing of a firearm without the use of real ammunition. As will be appreciated, this type of practice improves proficiency in such phases of marksmanship as holding the correct "sight picture" and coordinating breathing with trigger squeeze.

Known in the prior art are weapons simulator systems in which, for instance, a laser transmitter is attached above or under the barrel of a rifle with external batteries used to power the laser transmitter in response to the trigger being pulled.

In another known system the laser transmitter is triggered by acoustical energy developed by the firing mechanism of the firearm. The triggering means includes a sound energy to electrical energy transducer.

Although the latter type simulator, on the whole is adequate as regards its operation, a drawback is the frequent "false triggering" on account of the non-filtering of extraneous sounds.

Another drawback is the problem of providing the proper synchronizations between pulling the trigger and emitting an output signal.

A still further drawback of this prior art system is that such system is capable of utilizing only a single laser beam which, as will be appreciated, greatly affects and restricts the general operation of the laser transmitters as regards the aiming and hit and miss adjustments of the weapon.

SUMMARY OF THE INVENTION

Accordingly, it is a primary object of the subject invention to provide an improved laser transmitter system which overcomes the aforementioned disadvantages and which posesses improved desirable characteristics.

Another object is to provide a completely self-contained, "clamp-on" laser transmitter device which may be readily attached to a trainee's firearm.

Still another object is to provide a laser trainer device which is triggered in response to acoustical energy developed by the firing mechanism.

Still a further object is to provide a laser traner device which is triggered by acoustical energy as described above and which filters out extraneous sounds to prevent false triggerings.

In accordance with a preferred embodiment of the subject invention, the above-described advantages are obtained by a multiple laser beam transmitter system which comprises a laser device adapted to be attached on or near the barrel of a rifle or the like such that triggering of the weapon activates the laser transmitter and results in the laser device producing a plurality of beams in a manner such that by means of an adjustable diverging lens on the laser device the beams may be defocused to a degree so as to attain an overlapping pattern of the beams. The beams are transmitted sequentially by the laser head assembly while timing of the transmission of the beams is controlled by electronic beam encoding logic.

Other advantages of the invention will hereinafter become more fully apparent from the following description of the drawings, which illustrate a preferred embodiment, and thoughout which like reference numberals indicate like parts.

BRIEF DESCRIPTION OF THE DRAWINGS

FIG. 2, is an exploded diagrammatic side view of details of the laser transmitting devices attached to an automatic fire weapon;

FIG. *2a*, is a sectional end view of that portion of the transmitting device which is clamped on to the fire weapon;

FIG. *2b*, is a sectional view of that portion of the clamp assembly of the transmitting device which incorporates the star hole associated with the mechanical to electrical transducer illustrated in FIG. *2a;*

Figure 3:
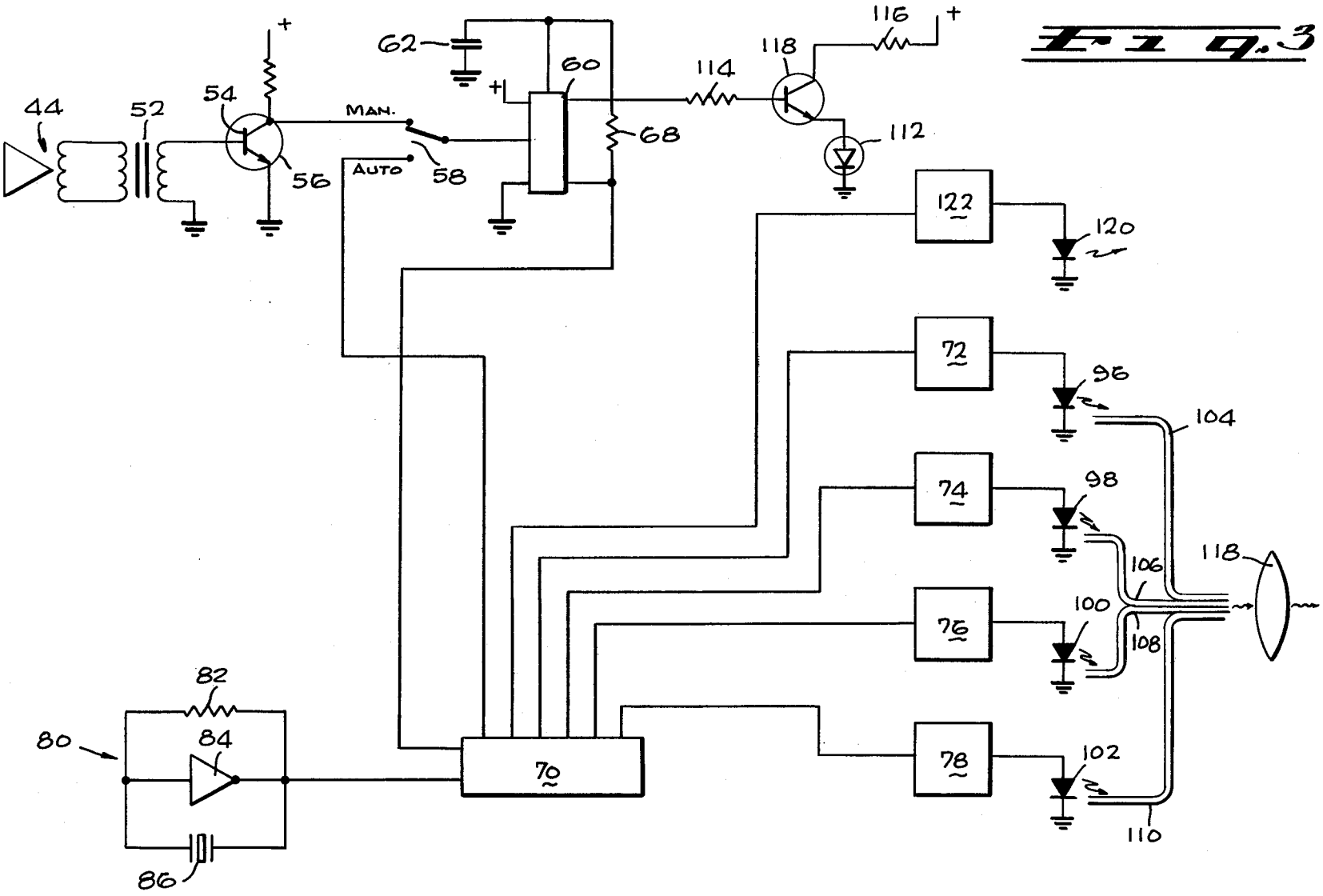
Figure 4:
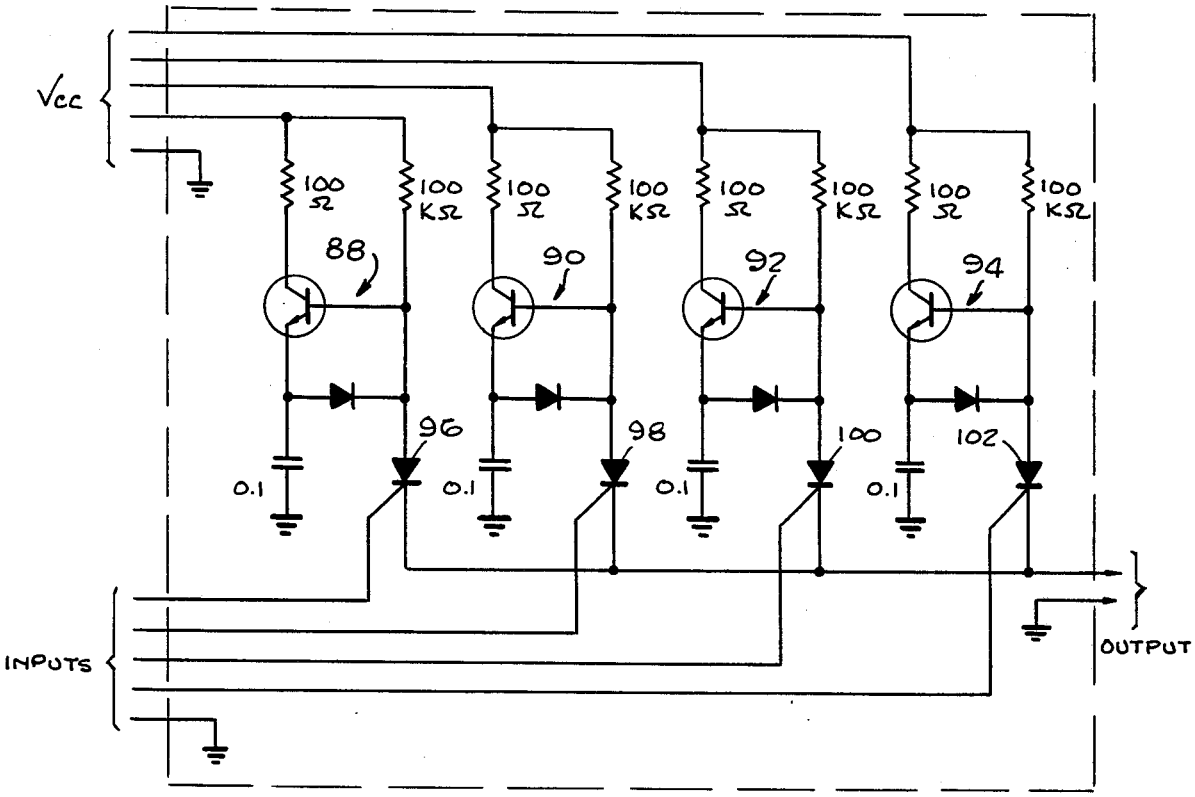
Figure 5:
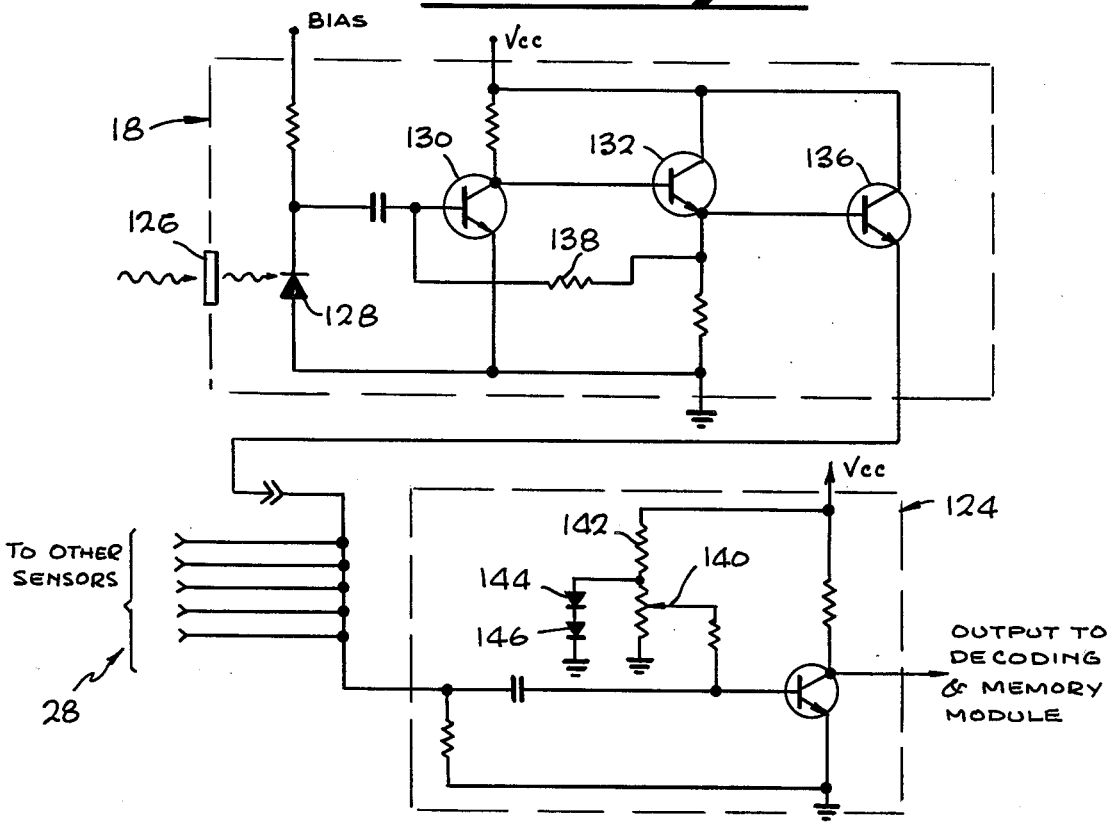
Figure 6:
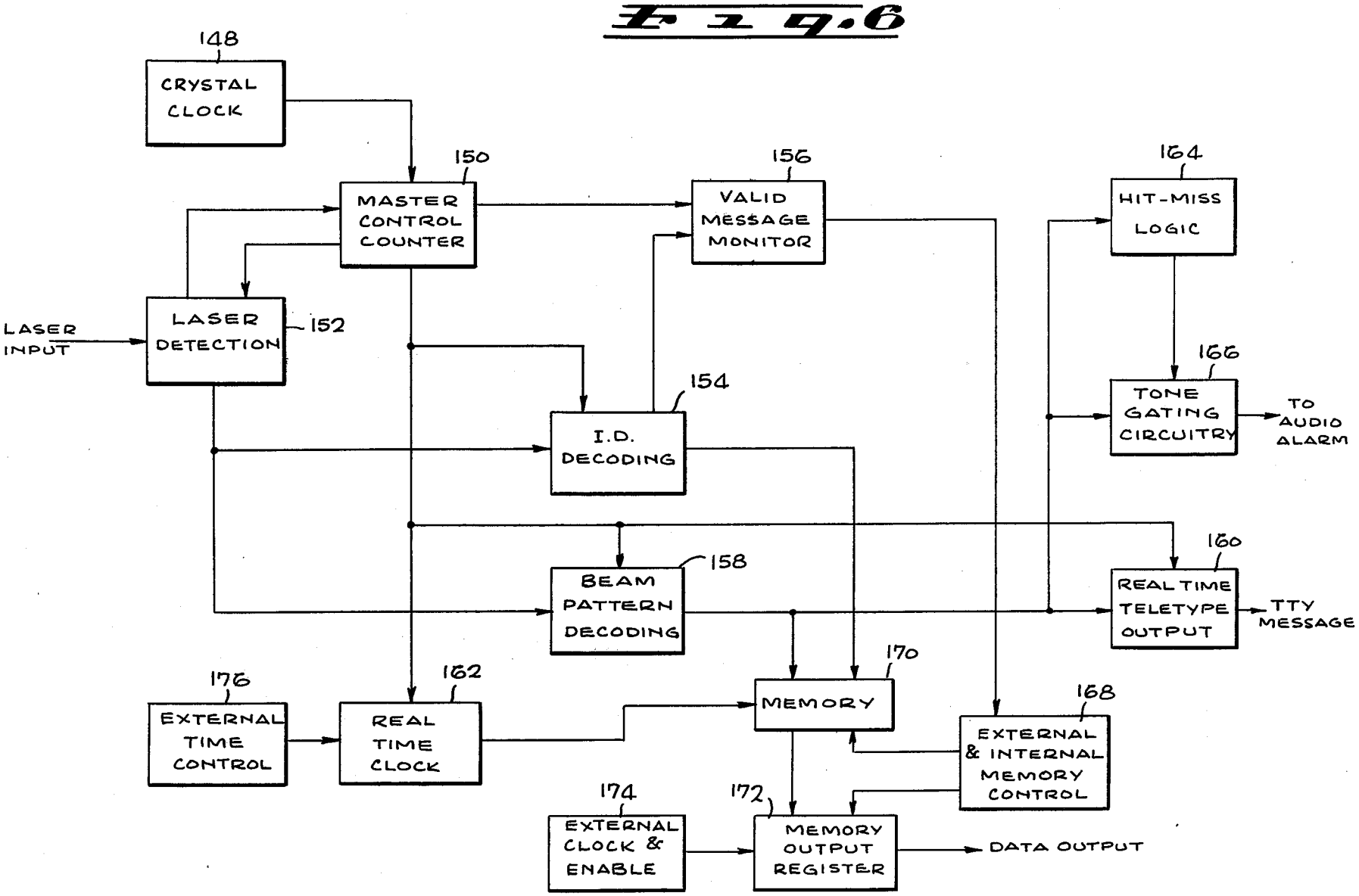

FIG. 3, is a block diagram illustrating a preferred embodiment of the circuitry of the laser transmitting device according to the invention;

FIG. 4, is a schematic circuit diagram of a suitable trigger circuit components incorporated in the laser circuitry of the laser transmitting device;

FIG. 5, is a schematic diagram of the laser beam sensing circuit incorporated in the laser circuitry; and, FIG. 6, is a detailed block diagram of the digital circuitry of the memory module incorporated in the laser circuitry of the laser transmitting device according to the invention.

DESCRIPTION OF THE PREFERRED EMBODIMENT

Figure 1:
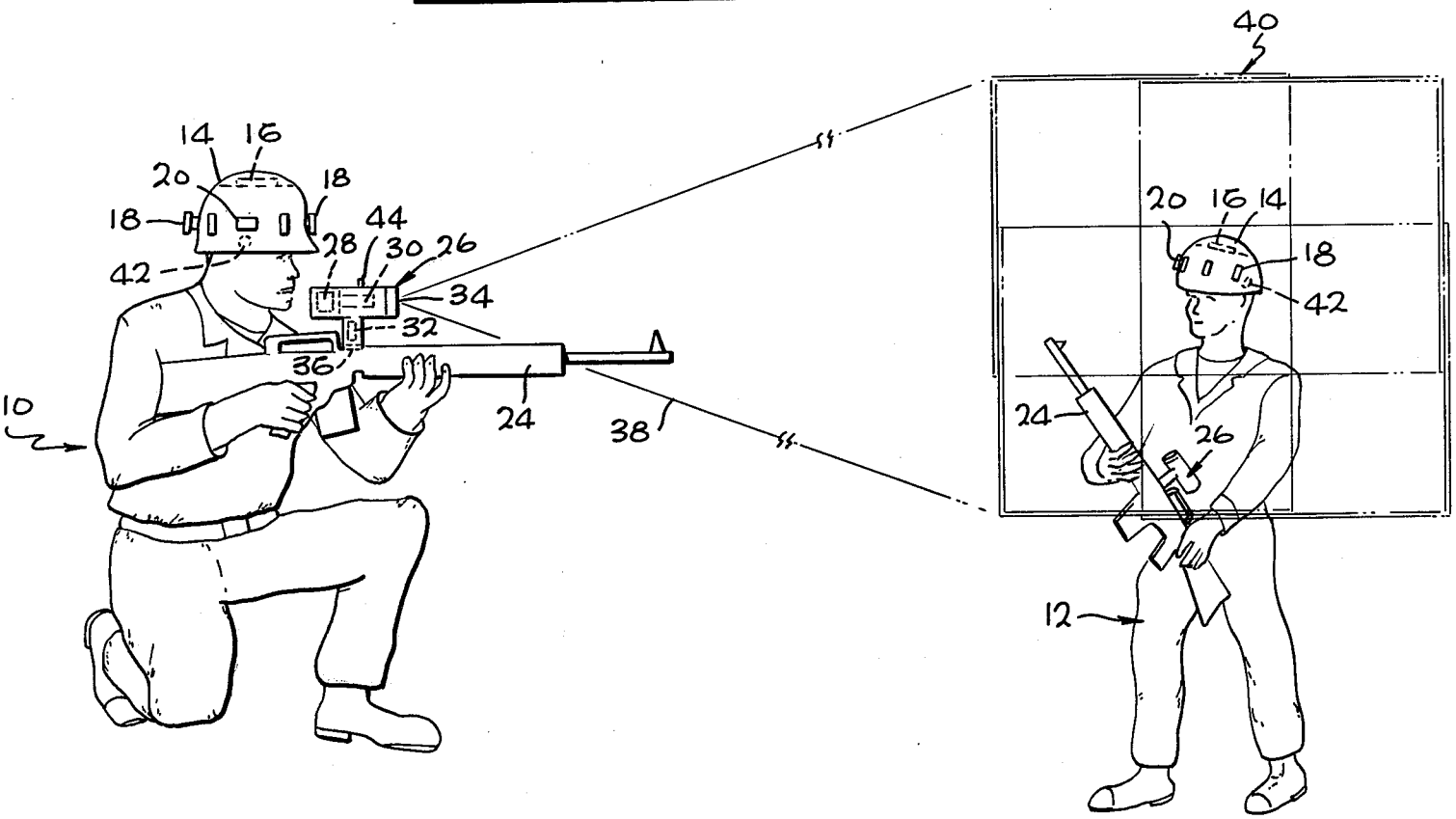
FIG. 1, is a schematic functional presentation of a man-to-man weapon fire kill simulator system incorporating the invention.

Referring to FIG. 1, there is shown two fighting men, trainees equipped with a laser engagement training system incorporating the invention. The trainees 10 and 12 are identically equipped and for convenience in reference identical equipment will be given the same numerical identification for each item of equipment. The trainees 10 and 12 are provided with helmet liners 14 containing a beam decoding and memory module 16, six sensors for 360° coverage 18, a battery box 20 and an audible hit indicator 42.

In addition each of the trainees 10 and 12 is provided with a weapon 24 equipped with a laser transmitter 26 comprising a power source 28, a laser head assembly 30, a beam encoding logic 32, a diverging lens 34, and an acoustical pickup 36.

As shown in FIG. 1, four laser beams 38 emanate when laser transmitter 26 is activated. The beams 38 are transmitted sequentially by the laser head assembly 30. Beam timing is controlled by the beam encoding logic 32. The lens 34 is adjustable on the device to slightly defocus the trajectory of the beams 38 to cause an overlapping beam pattern 40 arranged to illuminate one of the sensors 18. The beam pattern 40 detected by a sensor 18 is decoded and stored in the beam decoding and memory module 16. Depending on which part of the overlapping beam pattern 40 strikes the sensor 18, the degree and direction of near miss or direct hit data is stored in a memory device 16. The memory module 16 is capable to store a maximum of 1024 separate time-tagged messages or addresses containing hit or near miss data as well as weapon ID data. The audible alarm or hit indicator 42 is activated in response to a hit or near miss. The laser transmitter 26 also comprises a small Ga-As LED 44 to transmit "round-count" data from the laser transmitter 26 back to one of the sensors 18.

Shown in FIG. 2, are details of the acoustical pickup device 36 used to detect when the weapon 24 is fired. A small mechanical to electrical transducer 44 is provided and mounted in clamp assembly 46 of laser transmitter 26. When the clamp assembly 46 is mounted on the weapon 24, the transducer 44 extends in close proximity with a usual star hole 48. When the weapon 24 is fired, the pressure wave emerging from the star hole 48 is detected by the transducer 44. In response, the transducer 44 generates an electrical signal which is used to trigger the laser firing sequence. The transducer 44 is surrounded by suitable foam padding 50 and is not sensitive to mechanical shock and/or vibration induced in the weapon 24.

FIG. 3 illustrates details of the circuitry of the laser transmitter 26. The signal generated by the transducer 44 is stepped-up in voltage by a transformer 52 and applied to the base 54 of a transistor 56. A switch 58 is provided which when in the manual position, enables the output of transistor 56 to be fed to a "blanking one-shot" 60. A capacitor 62, oneshot 60 and a resistor 68 generate an 80 millesecond blanking pulse. The leading edge of the blanking pulse is used to enable a timing and control module 70. The laser timing and control module generates the synchronization, identification, and beam pattern pulses which are fed to trigger packs 72, 74, 76 and 78.

The timing of the pulse trains is very accurately controlled by a crystal clock circuit 80 consisting of a resistor 82, inverter 84 and a crystal 86. Quad trigger packs 78, 76, 74 and 72 are provided to generate the high voltage and high current pulses required to drive laser diodes 96, 98, 100 and 102. The output of the laser diodes 96, 98, 100 and 102 is formed into a square four beam overlapping pattern by means of fiber optics 104, 106, 108 and 110 and a collimating lens 118. The latter fiber optics are important in that they eliminate holes and hot spots in the projected beam pattern. When switch 58 is placed in the automatic position, the timing and control module 70 is pulsed automatically once a second to provide for testing and sight adjustment. The blanking pulse produced by oneshot 60 is also used to illuminate an LED status indicator 112. The status indicator 112 is used to provide visual indication that the laser timing sequence has been initiated. Resistors 114, 116 and a transistor 118 provide the drive for the LED 112. A small Ga-As LED 120 and associated trigger pack 122 is used to transmit the round count data back to the helmet.

FIG. 4 shows the circuit diagram of a quad trigger pack 88–94 with component values. The provisions of this circuit provides the capability to pulse each laser diode 96–102 4 times in every 100 microseconds.

FIG. 5, shows the circuit diagram of one of the sensors 18 (six are required) and associated variable threshold circuit 124. The sensor circuit, as shown, comprises an interference filter 126, a photo diode 128 which is AC coupled to a transimpedance amplifier consisting of transistors 130, 132 and 136. In this arrangement, amplifier gain is controlled by a resistor 138. The output of the six sensors 18 are paralleled and fed to threshold circuit 124. The gain of this threshold circuit is controlled by a potentiometer 140. A regulated bias source is formed by a resistor 142 and a pair of diodes 144 and 146. Threshold circuit 124 is set or adjusted just above the noise level by potentiometer 140.

FIG. 6, shows in detail the digital circuitry of the beam decoding and memory module 16 of FIG. 1. A crystal clock 148 provides 1/6 of accurate timing pluses to a master control counter 150. Master control counter 150 provides all timing and control signals for the proper operation of laser detector 152, ID decoder 154, valid message monitor 156, beam pattern decoder 158, real time pattern output 160, and a real time clock 162. The first laser pulse in the laser message activates the laser detection circuitry 152. The laser detection circuitry 152 enables the master control counter 150 to start the laser message decoding process. The master control counter 150 controls the laser detection circuitry 152 allowing the latter laser detection circuitry to only detect laser pulses in valid time slots. The master control counter 150 enables the laser detection circuitry 152 to receive one identification pulse in a possible 42 different time slots. After the identification time slots have been generated by the master control counter 150, the laser detection circuitry 152 is enabled to receive 4 beam pattern pulses. The identification decoding circuitry 154 records the 150 binary count of master control counter 150 when the laser detection circuitry 152 detects a laser pulse during one of the 42 identification time slots. The valid message monitor 156 is activated during the 42 identification time slots and monitors each time slot to insure that one and only one ID laser pulse is recevied. If the ID pulse is missing or if more than one is recorded, the entire laser message is rejected due to noise in the system or laser interference from one other source. The beam pattern decoding circuitry 158 is activated by the master control counter 150 after the 42 identification pulses have occurred. The master control counter 150 enables the beam pattern decoding circuitry 158 to record the output of the laser detector 152 during the 4 beam pattern time slots. The outputs of beam pattern decoder 158 are loaded into the real time teletype pattern output 160. The master control counter 150 shifts the data out of the real time teletype pattern output 160. The output of beam pattern decoding circuitry 158 is also present at the input to the hit miss logic circuitry 164. The hit miss logic 164 determines if the received pattern is a hit or a miss. Typically, a logic table is as follows:

| BEAM A | BEAM B | BEAM C | BEAM D | MISS | HIT |
|---|---|---|---|---|---|
| — | — | — | — | x | — |
| x | — | — | — | x | — |
| — | x | — | — | x | — |
| x | x | — | — | x | — |
| — | — | x | — | x | — |
| x | — | x | — | — | x |
| — | x | x | — | x | — |
| x | x | x | — | — | x |
| — | — | — | x | x | — |
| x | — | — | x | x | — |
| — | x | — | x | — | x |

-continued

| BEAM A | BEAM B | BEAM C | BEAM D | MISS | HIT |
|---|---|---|---|---|---|
| x | x | — | x | — | x |
| — | — | x | x | x | — |
| x | — | x | x | — | x |
| — | x | x | x | — | x |
| x | x | x | x | — | x |

x = true or present
— = false or absent

The tone gating circuitry 166 activates the audio alarms 22 shown in FIG. 1. The logic table for the activation of the audio alarms 22 of FIG. 1 is as follows:

| BEAM A | BEAM B | BEAM C | BEAM D | LEFT MOMENTARY | RIGHT MOMENTARY | LEFT CONSTANT ON | RIGHT CONSTANT ON |
|---|---|---|---|---|---|---|---|
| — | — | — | — | — | — | — | — |
| x | — | — | — | x | — | — | — |
| — | x | — | — | — | x | — | — |
| x | x | — | — | x | x | — | — |
| — | — | x | — | — | x | — | — |
| x | — | x | — | — | — | x | x |
| — | x | x | — | — | x | — | — |
| x | x | x | — | — | — | x | x |
| — | — | — | x | x | — | — | — |
| x | — | — | x | x | — | — | — |
| — | x | — | x | — | — | x | x |
| x | x | — | x | — | — | x | x |
| — | — | x | x | x | x | — | — |
| x | — | x | x | — | — | x | x |
| — | x | x | x | — | — | x | x |
| x | x | x | x | — | — | x | x |

x = on or present
— = off or absent

Referring back to FIG. 6, the external and internal memory control 168 writes the recorded data from the ID decoding 154, beam pattern decoding circuitry 158 and the real time clock 162 into memory. Real time clock 162 generates elapsed time for time tagging of the received laser messages. The output lines from memory 170 form the input lines to the memory output register 172. The external and internal memory control 168 control the timing of the input data into the memory output register 172. An external clock and enable 174 signal is used to shift the data out of the memory output register 172.

The external control signals of external and internal memory control 168 checks out the memory for proper operation. External time control unit 126 resets the real time clock 162. All external signals are generated by a systems checkout device, not shown.

From a detailed consideration of this description, it will be apparent to those skilled in the art that this invention may be employed in a number of different ways through the use of routine skill in this field. For this reason, the present invention is not to be considered as being limited except by the appended claims defining the invention.

I claim:

1. A fire simulator device adapted to be mounted on a weapon for emitting an output signal in response to mechanical force generated by the firing mechanism of the firearm, comprising:

an adjustable laser transmitter means for providing a plurality of sequentially transmitted beams of light;

means for controlling timing of said beams of light onto an exposed object;

first circuit means coupled to the output of said laser transmitter means for forming said plurality of sequentially transmitted beams of light into a four-beam overlapping pattern of beams; and second circuit means associated with said laser transmitter means for triggering the latter means in response to an electrical signal upon firing the weapon.

2. The device according to claim 1, further comprising beam detecting means for determining the direction and degree of a near miss or hit upon actuation of said laser transmitter means.

3. The device according to claim 2, wherein an acoustical pickup device is operative to detect when the weapon is fired and to determine the beam pattern of said beams of light.

4. The device according to claim 1, further comprising beam decoding and memory means operative in response to actuation of said laser transmitter means and detection of said plurality of sequentially transmitted beams of light.

5. The device according to claim 4, wherein a beam decoding and memory module is provided and operative to decode and store said beam of light following detection thereof by a sensor element.

6. The device according to claim 1, wherein said first circuit means for sequentially transmitting said beams into a four-beam pattern of light comprises four laser diodes each having their output coupled to fiber optics and a collimating lens.

7. The device according to claim 6, wherein said first circuit means further comprises Quad trigger packs coupled to said laser diodes to drive the latter.

8. The device according to claim 6, wherein said fiber optics are adapted to prevent holes and hot spots in the transmitted beam pattern.

9. The device according to claim 1, wherein said means for controlling the timing and sequence of said beams of light comprises a beam encoding logic.

10. The device according to claim 9, wherein said beam timing logic comprises a crystal clock including a resistor, an inverter and a crystal.

11. The device according to claim 1, further comprising a star hole and transducer means for transmitting a pressure wave in response to firing of the weapon to actuate said second circuit means.

12. The device according to claim 11, wherein said transducer means is operative to generate an electrical signal to trigger said laser transmitter means in response to pressure waves resulting from firing the weapon.

13. The device according to claim 11, wherein said star hole is associated with said transducer means and operative to transmit said pressure waves thereto.

14. The device according to claim 1, further comprising audible indicator means operative to indicate the degree and direction of near miss and direct hit of the transmitted overlapping beam pattern.

15. The device according to claim 1, wherein said adjustable laser transmitter means comprises a diverging lens adjustably operative to defocus the trajectory of said beam, thereby causing overlapping patterns of said beams of light.

16. In a fire simulator device adapted to be mounted on a weapon for emitting an output signal in response to the mechanical force generated by the firing mechanism of the firearm, a laser transmitter, comprising:

a laser head assembly adapted to sequentially transmit a plurality of beams of light, said assembly including an adjustable objective lens to defocus the trajectory of the transmitted beams to cause an overlapping beam pattern;

means associated with said laser head assembly to activate the latter upon firing the weapon to transmit said beams of light;

sensor means adapted to sense the transmitted beams of light;

memory means for storing and decoding the beam pattern detected by said sensor means;

means associated with said laser head asembly for timing the transmittal of said beams of light;

circuit means coupled to the output of said assembly for forming said plurality of sequentially transmitted beams of light into a four-beam overlapping pattern of beams, said circuit means including four laser diodes each having their output coupled to fiber optics, and a collimating lens, quad trigger packs being coupled to said laser diodes to drive the latter; and means associated with said sensor means to indicate a direct hit and near-miss of at least a portion of said beam overlapping pattern of beams.

* * * * *